US007120937B2

(12) United States Patent
Monshouwer

(10) Patent No.: US 7,120,937 B2
(45) Date of Patent: Oct. 17, 2006

(54) HEADGEAR WITH HIDDEN COMPARTMENT

(75) Inventor: Herman Jacques Monshouwer, Chonburi (TH)

(73) Assignee: World Magic International (W.M.I.), Oranjestad (AW)

( * ) Notice: Subject to any disclaimer, the term of this patent is extended or adjusted under 35 U.S.C. 154(b) by 0 days.

(21) Appl. No.: 11/030,599

(22) Filed: Jan. 6, 2005

(65) Prior Publication Data

US 2005/0210563 A1 Sep. 29, 2005

(30) Foreign Application Priority Data

Feb. 23, 2004 (TH) ..... 088 932
Mar. 16, 2004 (NL) ..... 1025739

(51) Int. Cl.
*A42B 1/04* (2006.01)

(52) U.S. Cl. ..... 2/171

(58) Field of Classification Search ..... 2/422, 2/171, 175.4, 195.5
See application file for complete search history.

(56) References Cited

U.S. PATENT DOCUMENTS 5,465,426 A * 11/1995 Beaton ..... 2/195.1
5,548,847 A * 8/1996 Spicijaric ..... 2/209.13
5,724,678 A * 3/1998 McCallum et al. ..... 2/209.13
6,023,788 A * 2/2000 McCallum et al. ..... 2/209.13
2002/0100106 A1* 8/2002 Simmons ..... 2/171.2

* cited by examiner

*Primary Examiner*—John J. Calvert
*Assistant Examiner*—Andrew W. Sutton
(74) *Attorney, Agent, or Firm*—Ryan A. Schneider, Esq.; Troutman Sanders, LLP.

(57) ABSTRACT

A cap (1), preferably in the form of a baseball cap, including a hood (3) with a hood edge (33, 34), as well as a lining (4) which extends along at least a part of the inner surface of the cap (3). The lining (4) has a lining part (41) which is fixed to the hood (3), and at least one edge part (42) which is loose from the hood (3). The loose lining edge part (42) is provided with a flexible reinforcement member (50), for example a whalebone.

6 Claims, 6 Drawing Sheets

HEADGEAR WITH HIDDEN COMPARTMENT

BENEFIT CLAIM

This application claims the benefit of Dutch Patent Application No. 1025789, filed 16 Mar. 2004 and Thai Patent Applciaiton No. 088932 filed 23 Feb. 2004.

FIELD OF THE INVENTION

Generally, the present invention relates to a headgear, more specific a cap, usable as magician's attribute, in which objects can be invisibly hidden.

BACKGROUND OF THE INVENTION

An objective of the present invention is to provide a new magician's attribute in the form of a headgear, more specific a cap, hereinafter referred to as "magic cap", which can be manufactured in a very simple way, and in which a magician can easily hide and reveal objects.

SUMMARY OF THE INVENTION

Thus, the invention provides a headgear, preferably in the form of a cap, comprising:

a hood with a hood edge;

a lining extending along at least a part of the inner surface of the hood;

the lining having a lining part fixed to the hood, and at least one edge part which is loose from the hood;

wherein the loose lining edge part is provided with a flexible reinforcement member, for example a whalebone.

BRIEF DESCRIPTION OF THE DRAWINGS

These and other aspects, features and advantages of the present invention will be further explained by the following description of a preferred embodiment of a cap according to the present invention, with reference to the drawings, in which equal reference numbers indicate same or similar parts, and in which.

Figure 1A:
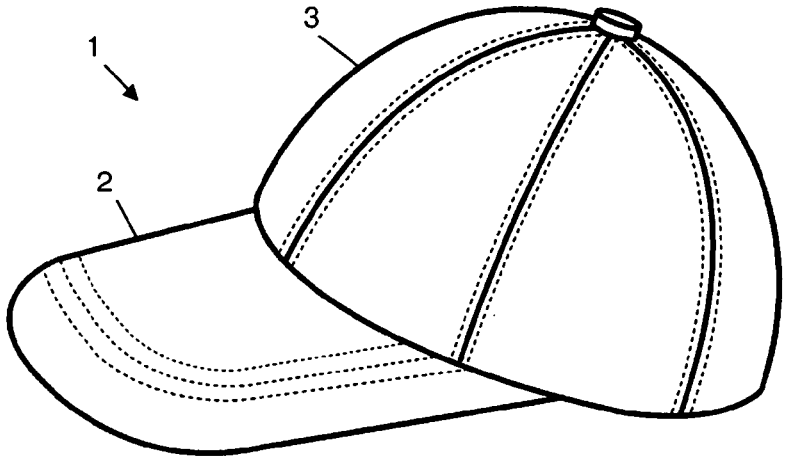
FIG. 1A schematically shows a perspective top view of a magic cap according to the present invention.
Figure 1B:
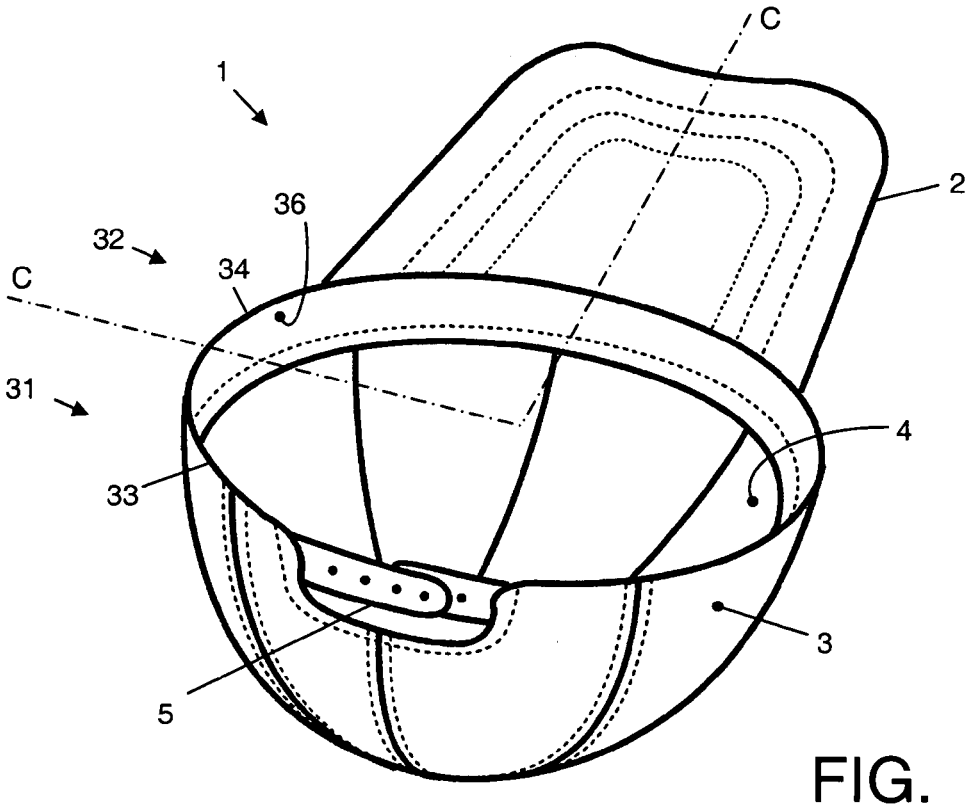
FIG. 1B schematically shows a perspective bottom view of a magic cap according to the present invention.
Figure 1C:
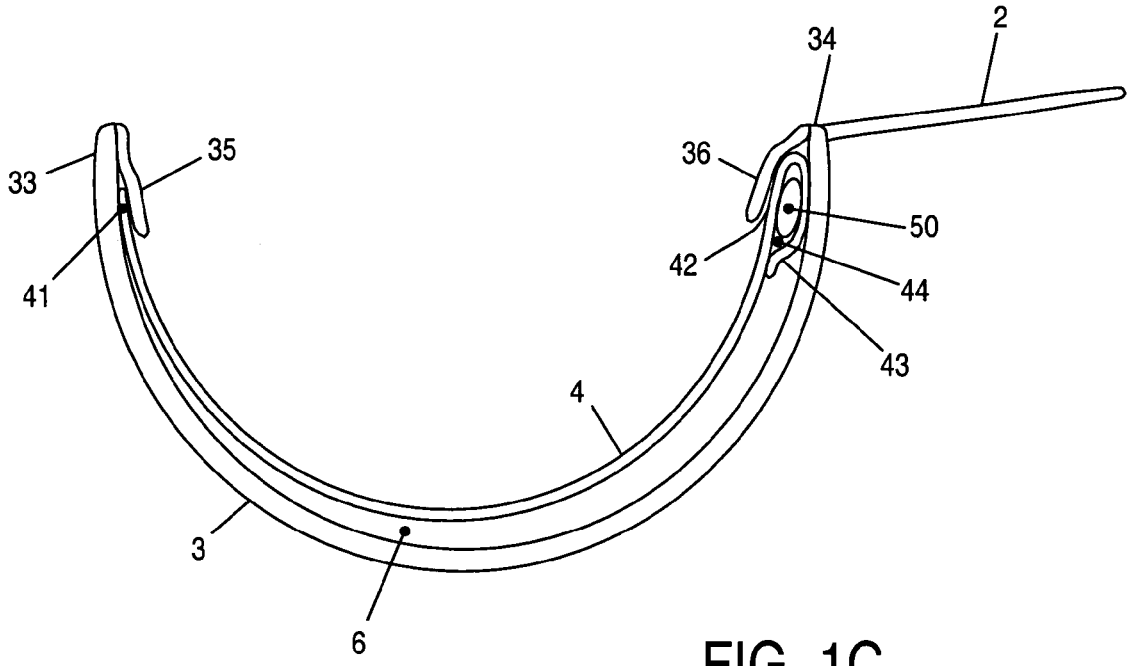
FIG. 1C is a schematic cross section of the cap according to the line C—C in FIG. 1B.
Figure 3A:
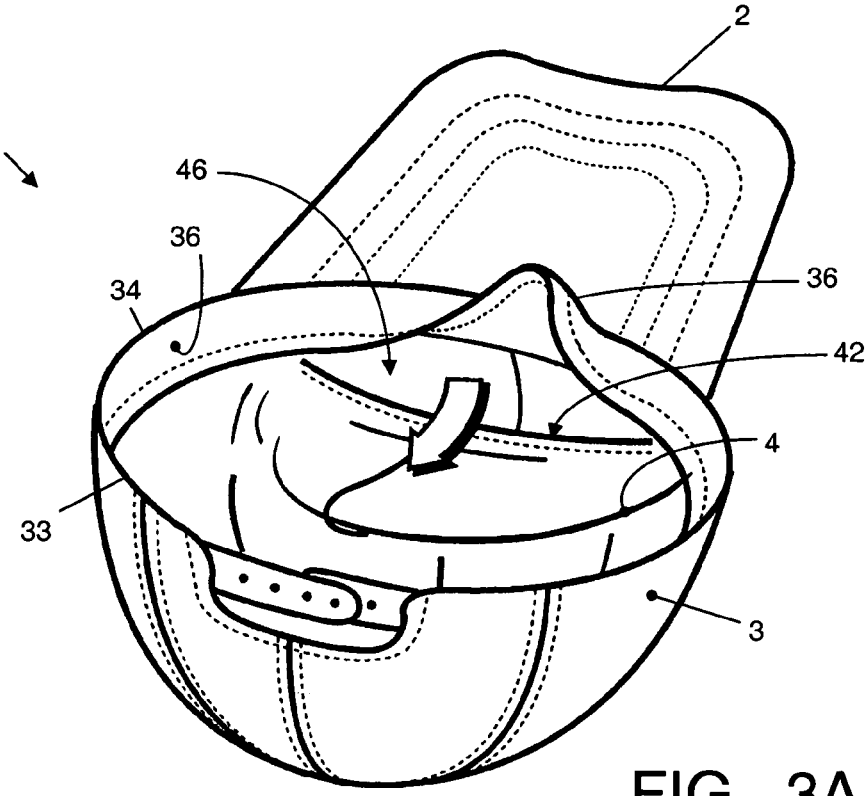
Figure 3B:
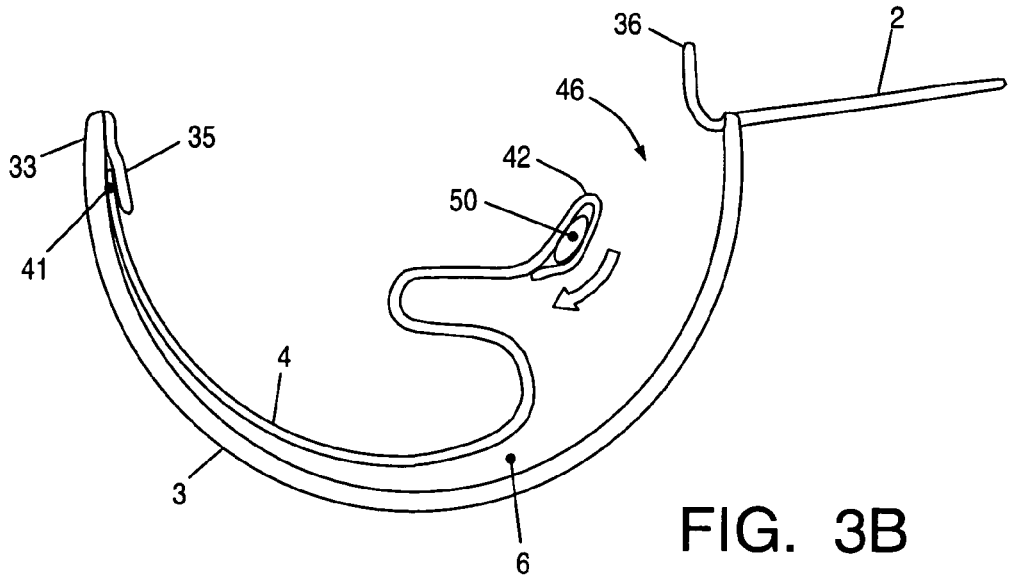
Figure 5A:
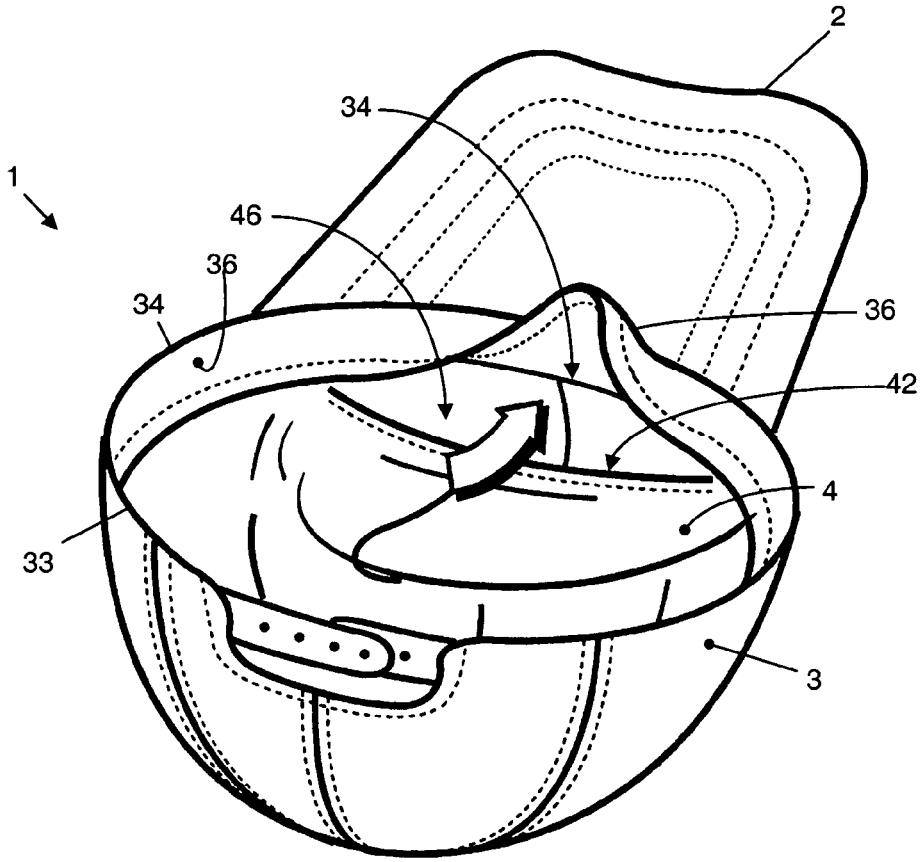
Figure 5B:
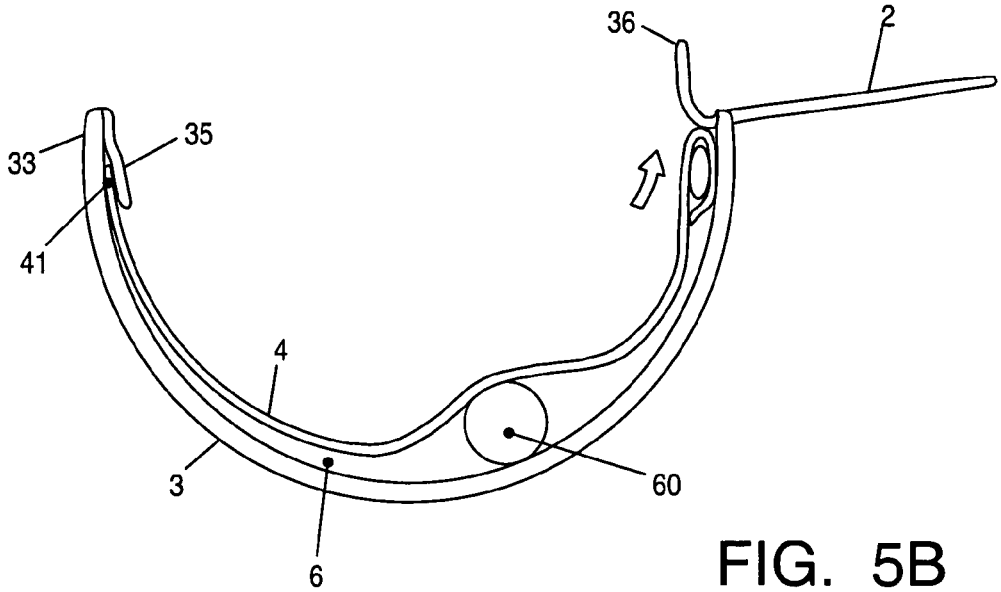

the FIGS. 3B and 5B are cross sections of the cap similar to FIG. 1C during the stages of use illustrated in the FIGS. 3A and 5A, respectively.

DETAILED DESCRIPTION OF THE INVENTION

FIG. 1A schematically shows a perspective view of a magic cap 1. FIG. 1B schematically shows a perspective view of the magic cap 1 in turned round position, i.e. with the bottom side up, and FIG. 1C is a schematic cross section according to the line C—C in FIG. 1B.

The magic cap 1 is a headgear with the shape of a cap, more specific a baseball cap, with a visor 2 and a hood 3. Since baseball caps are known per se, an extensive explanation is unnecessary. It suffices to note, that the hood 3 has a shape of a reversed bowl, for example approximately a hemisphere shape, and is provided on its inside with a lining 4, which is shown exaggeratedly thick in the cross section drawings. According to an important aspect of the present invention, the cap 1 has a storage compartment 6 between the hood 3 and the lining 4, as will be explained later in more detail.

As is well visible in FIG. 1B, the hood 3 has an adjustment band 5, for adjusting the cap 1 to the circumference of the user's head. The adjustment band 5 is a strong band, usually made of a synthetic material, and comprises two band parts, the ends of which can be adjustably attached to one another, as is known per se.

In the following, a rear hood half 31 and a front hood half 32 of the hood 3 will be distinguished. The front hood half 32 is the hood half to which the visor 2 is attached. The read hood half 31 is located opposite the front hood half 32.

The hood 3 has a free peripheral edge, the part of which corresponding to the rear hood half 31 will be referred to as rear peripheral edge 33, while the part corresponding to the front hood half 32 will be referred to as front peripheral edge 34.

Figure 2:
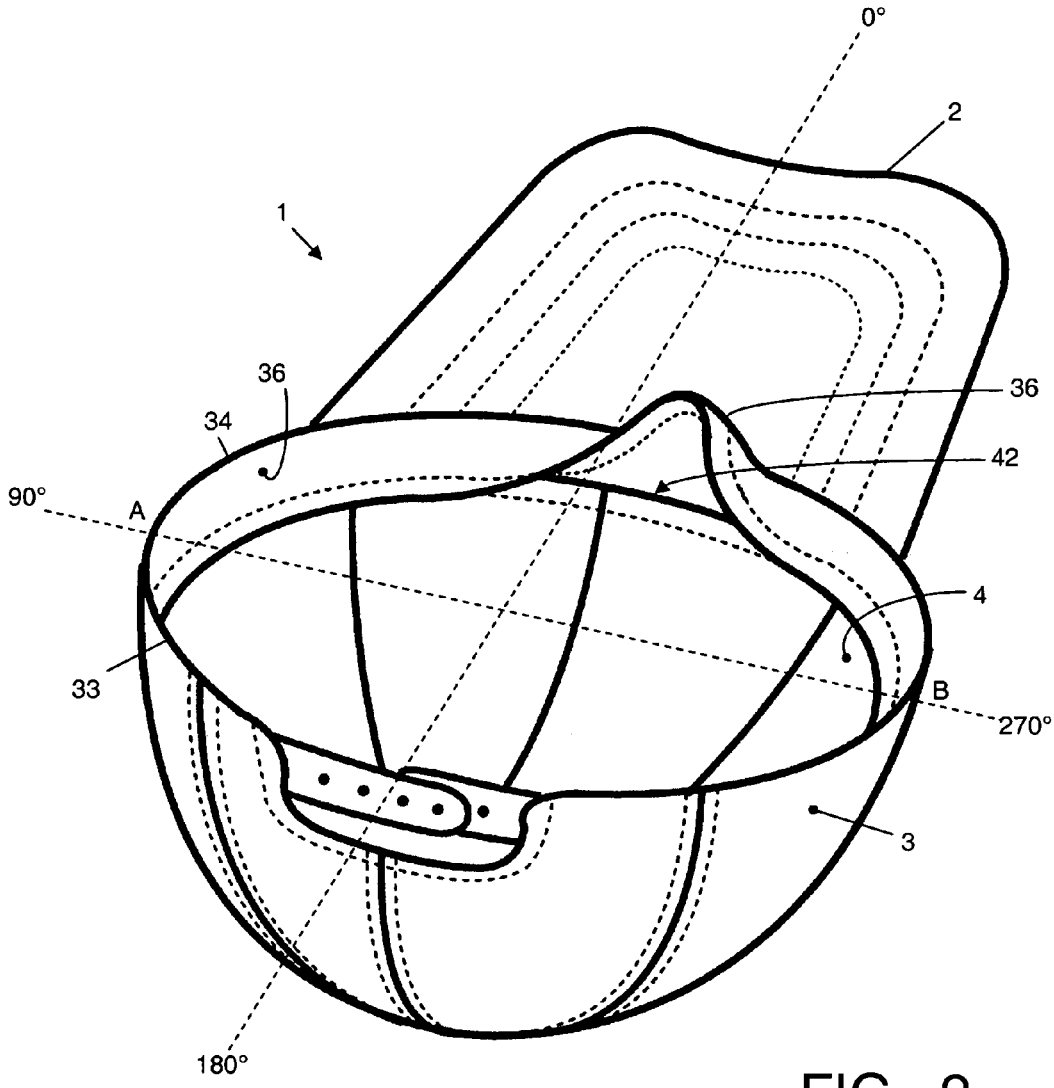
FIGS. 2, 3A, 4, 5A are perspective bottom views of the cap similar to FIG. 1B during successive stages of the use of the cap.

FIG. 2 is a schematic perspective bottom view of the cap 1, in which a dotted coordinate system is shown, of which the 0°-line is aligned with the centre of the visor 2. The 90°-line and the 270°-line correspond to the right-hand side and the left-hand side of the cap 1, respectively, while the 180°-line corresponds to the rear side of the cap 1. The rear hood half 31 corresponds to the peripheral area from 90° via 180° to 270°, while the front hood half 32 corresponds to the peripheral part from 270° via 0° to 90°.

The lining 4 has a peripheral edge, also referred to as lining edge, which is attached to the hood 3 over part of its length. The part of the lining edge that is fixed to the hood 3 will hereinafter be referred to as fixed lining edge 41, while the part of the lining edge that is unattached to the hood 3 will hereinafter be referred to as loose lining edge 42. In the shown example, the fixed lining edge 41 extends along the rear peripheral edge 33 of the rear hood half 31; alternatively, however, it is possible that the fixed lining edge 41 extends along another part of the peripheral edge of the hood. However, it is not necessary that the fixed lining edge extends along the peripheral edge of the hood, although that is preferred because then the storage space 6 is as large as possible; alternatively, the fixed lining edge can extend over a central part of the hood 3.

According to an important aspect of the present invention, the loose lining edge 42 is provided with a flexible reinforcement member 50, for example a whalebone, which is shown exaggeratedly thick in the figures. The lining edge 42 can be fixed to the whalebone 50, or the lining edge 42 can have a turnup 43 sewn onto the lining edge 42, hereby forming a pocket 44 in which the whalebone 50 is loosely contained.

The loose lining edge 42 defines an entrance opening 46 for the storage space 6. In the normal using position of the cap 1, the reinforcement member 50 extends substantially parallel to the peripheral edge of the hood 3; then the entrance opening 46 is "closed". The reinforcement member 50 is rigid enough to hold the loose lining edge 42 along the peripheral edge of the hood 3, so that it is not visible that the lining edge 42 is actually "loose".

The length of the loose lining edge 42 and the whalebone 50 is not critical, but is preferably approximately equal to 180°, measured along the peripheral edge of the hood 3, in which case the whalebone 50 extends from the 90°-point A, via the 0°-point to the 270°-point B. It is noted, that the length of the whalebone 50 does not have to exactly equal the length of the loose lining edge 42.

Preferably, the hood 3 is provided with a hood turnup 35, 36, extending from the hood edge 33, 34 over a small length (a few centimetres is sufficient) on the inner side of the hood 3, over the lining 4, so that the lining edge 41, 42 is hidden from view. Preferably, and as shown in FIG. 1C, a rear part 35 of the hood turnup is fixed to the inner side of the hood 3, but the hood turnup may also be unattached over the whole perimeter of the hood edge. According to an important aspect of the present invention, the front part 36 of the hood turnup, corresponding to the loose lining edge 42, is free from the hood and the lining.

If desired, also the front part 36 of the hood turnup can be provided with a whalebone or the like, in order to, in the "normal" using condition of the cap 1, hold the hood turnup with certainty over the loose lining edge 42.

The use of the magic cap 1 is as follows. In the normal using condition, the shape of the cap 1 is as illustrated in the FIGS. 1B and 1C. The whalebone 50 extends along the front hood edge 34, so that the lining 4 covers the whole inner side of the hood 3 and the entrance opening 46 of the storage space 6 is closed. The front hood turnup 36 is folded back over the front lining edge 42 with the whalebone 50, so that the front lining edge 42 is not visible.

Figure 4:
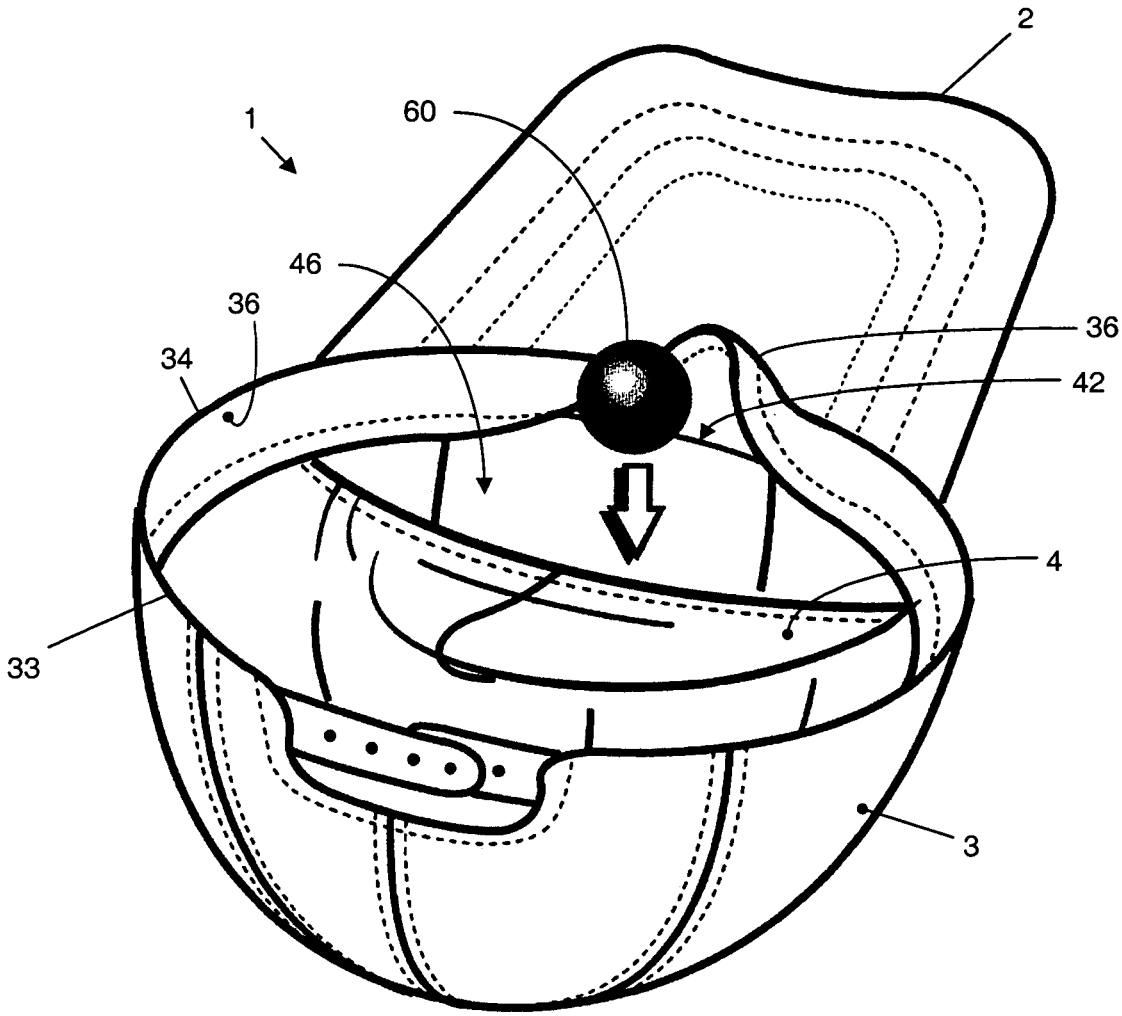

When it is required to hide an object in the cap, the user lifts up the front hood turnup 36, as illustrated in FIG. 2, and pulls the front lining edge 42 with the whalebone 50 backwards, as schematically shown in the FIGS. 3A and 3B, to open the entrance opening 46 of the storage space 6. Now an object 60, in this example a ball, can be put into the storage space 6 between the lining 4 and the hood 3, as illustrated in FIG. 4.

Then, the user brings the whalebone back to its position along the front hood edge 34, as shown in the FIGS. 5A and 5B, and folds the front hood turnup 36 back over the front lining edge 42, so that the situation sketched in FIG. 1B is attained again. Now, the object 60 is not visible from the outside. For an improved invisibility, it is preferred to implement the lining 4 in a black colour. The outer side of the cap 3 can also be implemented in a black colour, but can also, if desired, be provided with colourful patterns, so that possible curvatures as a result of the object arranged in the storage space 6 will hardly be visible.

The removal of an object 60 from the storage space 6 happens in the opposite order, as will be clear to a person skilled in the art.

It will be clear to a person skilled in the art that the invention is not limited to the embodiments discussed above, but that several variations and modifications are possible within the protective scope of the invention as defined in the attached claims.

For example, it is possible that the cap has two storage spaces, one at the front side of the cap and one at the rear side of the cap, in which case the lining will be attached to the hood in a central part, and a rear lining edge, just like the front lining edge, will be unattached to the hood en will be provided with a reinforcement member such as a whalebone, while the hood turnup will be loosely folded inwards in both the rear part and the front part.

What is claimed is:

1. Headgear, preferably in the form of a cap, comprising:

a hood with a hood edge;

a lining extending along at least a part of the inner surface of the hood;

the lining having a lining part fixed to the hood, and at least one edge part which is loose from the hood; and the lining having a peripheral edge, a first part of the peripheral edge being attached to the hood, and a second part of the peripheral edge being loose from the hood, wherein the loose lining edge part is provided with a flexible reinforcement member, for example a whalebone, and wherein between the hood and the lining is defined a storage space, and wherein the dimensions of the lining are such that, in a normal using condition of the headgear, the said loose edge part with the flexible reinforcement member extends along a part of the hood edge.

2. Headgear according to claim 1, wherein the hood, at least along the said first hood part, is provided with a loose hood turnup which, when folded inwards, lies over the loose lining edge part.

3. Headgear according to claim 1, wherein, in a normal using condition of the headgear, the loose lining edge part and the reinforcement member associated therewith extends over approximately 180° of the hood edge.

4. Headgear according to claim 1, wherein the dimensions of the lining substantially correspond to the dimensions of the hood.

5. Headgear, preferably in the form of a cap, comprising:

a hood with a hood edge;

a lining extending along at least a part of the inner surface of the hood; the lining having a lining part fixed to the hood, and at least one edge part which is loose from the hood; and the lining having a peripheral edge, a first part of the peripheral edge being attached to the hood, and a second part of the peripheral edge being loose from the hood, wherein the loose lining edge part is provided with a flexible reinforcement member, for example a whalebone, wherein between the hood and the lining is defined a storage space, wherein the dimensions of the lining substantially correspond to the dimensions of the hood wherein the hood, substantially along the endure hood edge, is provided with a hood turnup with a loose hood turnup part the length of which substantially corresponds to the length of the loose lining edge part, wherein the remaining hood turnup part is folded inwards, over the fixed lining edge, and possibly is attached thereto, and wherein the loose hood turnup part, when folded inwards, lies over the loose lining edge part.

6. Method for placing an object in a storage space between the hood and the lining of a headgear, the headgear preferably in the form of a cap, comprising:

a hood with a hood edge;

a lining extending along at least a part of the inner surface of the hood;

the lining having a lining part flexed to the hood, and at least one edge part which is loose from the hood; and the lining having a peripheral edge, a first part of the peripheral edge being attached to the hood, and a second part of the peripheral edge being loose from the hood, wherein the loose lining edge part is provided with a flexible reinforcement member, for example a whalebone, and wherein between the hood and the lining is defined a storage spaces; and the method comprising the steps of:

lifting the loose turnup part;

pulling aside the loose lining edge part with the reinforcement member associated therewith;

inserting the object via the opening between the loose lining edge part and the hood edge;

bringing back the loose lining edge part with the reinforcement member associated therewith to the starting position substantially parallel to the hood edge;

folding the loose hood turnup part back inwards.

* * * * *